US005652982A

United States Patent [19]

Kiefer et al.

[11] Patent Number: 5,652,982

[45] Date of Patent: Aug. 5, 1997

[54] WALL HAMMOCK FOR USE IN THE SITTING POSITION

[76] Inventors: Brad R. Kiefer; Nancy R. Kiefer, both of 2624 Willis, Perry, Iowa 50220

[21] Appl. No.: 670,263

[22] Filed: Jun. 21, 1996

[51] Int. Cl.[6] ..... A45F 3/22; A45F 3/24

[52] U.S. Cl. ..... 5/634; 5/120

[58] Field of Search ..... 5/633, 634, 120, 5/122, 127, 488

[56] References Cited

U.S. PATENT DOCUMENTS

| | | | |
|---|---|---|---|
| 972,712 | 10/1910 | Palmer | 5/634 |
| 1,063,423 | 6/1913 | Edelin | 5/633 |
| 1,156,125 | 10/1915 | Ahlborn | 5/634 |
| 1,201,640 | 10/1916 | Schimmel | 5/634 |
| 1,749,888 | 3/1930 | Reeder | 5/122 |
| 2,245,121 | 6/1941 | Abresch . | |
| 2,496,592 | 2/1950 | Morgan . | |
| 2,572,469 | 10/1951 | Gimmler . | |
| 2,663,880 | 12/1953 | Meeks . | |
| 3,482,271 | 12/1969 | Enright . | |
| 3,774,247 | 11/1973 | Bradley . | |
| 4,015,298 | 4/1977 | Scott | 5/634 |
| 4,853,993 | 8/1989 | Walpin et al. | 5/634 |
| 4,955,094 | 9/1990 | Mullaly | 5/53.2 |

*Primary Examiner*—Alexander Grosz
*Attorney, Agent, or Firm*—Henderson & Sturm

[57] ABSTRACT

A wall hammock includes a frame and a hammock. The frame is mounted on a wall above a bed or any other desired location. A first end of the hammock is removably attached to the frame. The second end of the hammock rests on the floor, on a bed, or on any substantially horizontal surface. The second end of the hammock is held in position by the lower torso of the user. The frame can also include a shelf. When the hammock is not in use, it can be easily rolled up and stored on the shelf. A cover can be positioned over the frame to keep the hammock out of sight when not in use.

15 Claims, 2 Drawing Sheets

WALL HAMMOCK FOR USE IN THE SITTING POSITION

TECHNICAL FIELD

The present invention relates generally to back rests and more particularly to back rests for supporting the torso of a human body with one end of the back rest supported by a frame and the other end of the back rest supported by the weight of the user.

BACKGROUND ART

Numerous back rest devices for supporting the torso of the user have been proposed. Some of these back supports utilize a padded board attached to a mechanical device that can be locked into position to support the torso of the user. The mechanical devices are often incorporated into the headboard of a bed or mounted on a wall over the bed. The disadvantages of mechanical backrests that are incorporated into the headboard of a bed are that they can only be used while the user is in bed and are limited to only a few different angles of inclination.

Other devices are comprised of a frame with a fabric material stretched between the members of the frame. Backrests of this type can be hooked onto the headboard of a bed or they can be free standing. A major disadvantage of this type of backrest is that the rigid frame must be assembled or unfolded and set up at the desired location. The rigid frame is often uncomfortable and does not conform around the user's torso for comfort.

Still other back rests are simply made of foam material shaped in various ways to be propped up against the wall, head board, or other similar support. These types of back rests are undesirable because the angle of inclination and conformity to the user's torso is limited to the shape and softness of the foam.

Therefore, there is a need for a device that can support the human torso in a variety of positions, including from nearly upright to nearly horizontal, that is comfortable, quick and easy to set up, and easily stored when not in use.

DISCLOSURE OF THE INVENTION

The present invention relates generally to back rests and more particularly to back rests for supporting the torso of a human body with one end of the back rest supported by a frame and the other end of the back rest supported by the weight of the user. The wall hammock of the present invention comprises a frame and hammock. The frame is easily mounted on a wall above a bed or any other substantially vertical surface at a desired location.

One end of the hammock is removably attached to the frame. The other end rests on a horizontal surface below the frame. The horizontal surface could be any relatively horizontal surface including a floor, the ground, or a bed. The end of the hammock positioned on the horizontal surface is held in place by positioning it beneath the lower torso of the user. A flexible or rigid member can be placed along the end of the hammock positioned on the horizontal surface to assist in maintaining the hammock in a spread-out configuration.

The frame at one end, and the weight of the user at the other end, keeps the hammock in the desired position and at the desired angle of inclination to support the torso. The user can position himself or herself up and down the length of the hammock to change the angle of inclination of the torso from a nearly vertical position to a nearly horizontal position. When the hammock is not in use, it can be easily collected up and stored within the wall mounted frame of the hammock. The frame can include a shelf on which the hammock can be placed. The collection of the hammock can be accomplished in many ways including rolling the hammock up and folding the hammock. A cover can be positioned over the frame to keep the hammock out of sight when not in use.

An object of the present invention is to provide a wall hammock back rest which utilizes a hammock supported at one end by a frame and which is held in position at the other end by the lower torso of the user.

Another object of the present invention is to provide a wall hammock back rest which can be positioned through a wide range of inclined positions and which can easily conform to the shape of the user. 1 Still another object of the present invention is to provide a wall hammock back rest which is capable of being collected and stored within the frame.

Another object of the present invention is to provide a wall hammock back rest which can be covered when not in use.

Other objects, advantages, and novel features of the present invention will become apparent from the following detailed description of the invention when considered in conjunction with the accompanying drawings

BEST MODES FOR CARRYING OUT THE INVENTION

Figure 1:
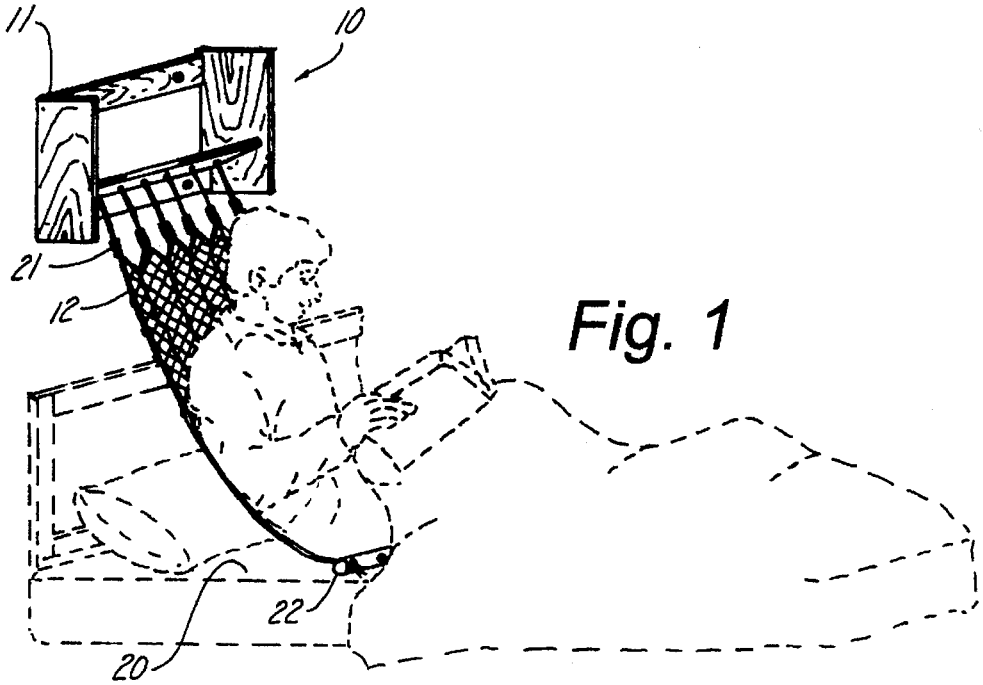
FIG. 1 is a perspective view of a back rest built in accordance with the present invention while in use with the user on a bed.

To assist in a better understanding of the invention, a description of different forms and embodiments of the invention will now be described in detail. Reference will be made to the accompanying drawings. Reference numbers will be used in the drawings to indicate specific parts and locations on the drawings. The same reference numerals will be used throughout the drawings unless otherwise indicated. It is to be understood that the scope of the invention is not limited to the specific embodiments discussed herein.

Figure 2:
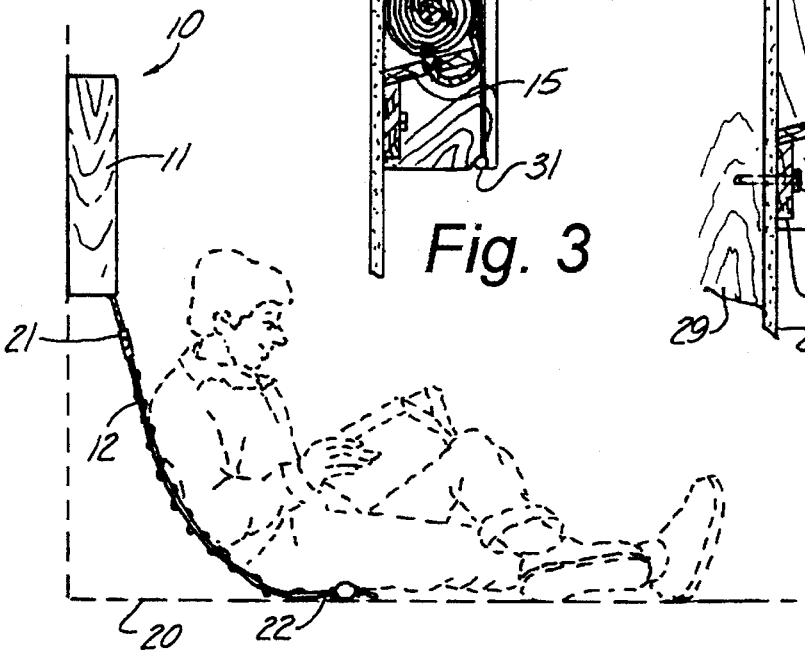
FIG. 2 is a side view of the present invention while in use with the user sitting on the floor.

Referring now to FIGS. 1 and 2, a wall hammock (10) built in accordance with the present invention is shown. The wall hammock (10) includes a frame (11) and a hammock (12). The frame is connected securely to a relatively vertical surface such as a wall. One end of the hammock (21) is attached to the frame (11). The other end of the hammock (22) rests on a supporting surface (20). The supporting surface may be a bed, the floor, the ground, or any other relatively horizontal surface.

The wall hammock is used to provide back support for a user in the sitting position. The wall hammock (10) of the present invention is used by extending the end (22) of the hammock (12) out from the frame (11). The user of the wall hammock (10) then sits on the extended end (22). The end (22) of the hammock (12) is held in place on the supporting surface (20) by the weight of the user. The user can adjust the degree of inclination of his or her torso on the hammock (12) by extending the end (22) of the hammock (12) further away from the frame (11).

In a preferred embodiment, the frame (11) is made of wood. The frame could also be made out of any other type of material which is capable of supporting the frame end (21) of the hammock (12). Also in a preferred embodiment, the hammock (12) is made of a woven rope material as shown in the drawings. However, the hammock (12) also can be made of any flexible material such as cloth, canvas or nylon.

The frame (11) can be mounted on virtually any substantially vertical surface and should not be limited to placement on a wall. Variations in the frame (11) design could allow for the frame to be mounted on virtually anything which is sufficiently above the relatively horizontal surface on which the extended end (22) of the hammock rests. The frame (11) could conceivably be mounted on locations such as a tree, a pole, a vehicle bumper or a table. Mountable locations such as these should be considered included within the scope of the present invention when discussing what is a suitable substantially vertical mounting surface. The frame could actually be part of the wall itself if desired. Additionally, variations in frame design to accommodate such mounting locations should also be considered within the scope of the present invention as claimed.

Figure 3:
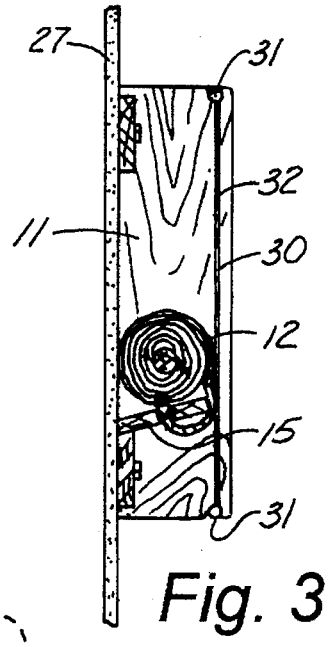
FIG. 3 is a sectional view of the present invention showing the hammock rolled-up and stored and also showing the removable cover in position.
Figure 4:
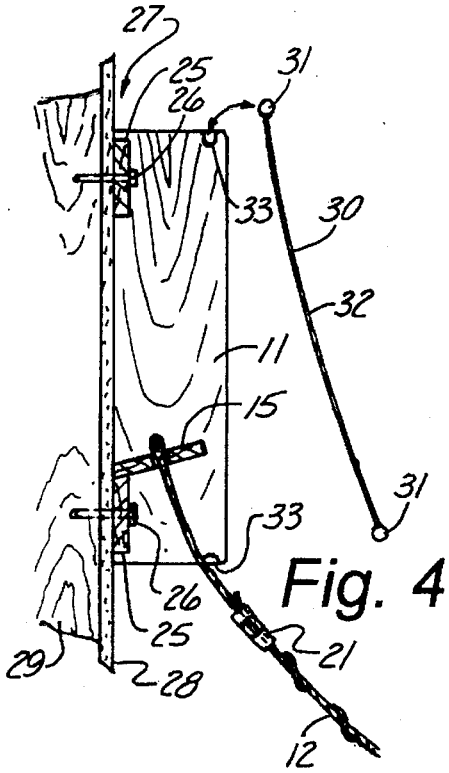
FIG. 4 is a sectional view of the present invention showing the hammock in an unrolled position and also showing the cover being removed.

Referring now to FIG. 3, the frame (11) is shown attached to a wall (27). The frame (11) includes a hammock support member (15). The hammock support member (15) is used to secure the hammock (12) to the frame (11). The hammock support member (15) also serves as a shelf. The hammock (12) can be collected and placed inside the frame (11) on the hammock support member (15). The hammock support member (15) can be positioned on an incline such that it helps to maintain the collected hammock (12). The hammock (12) is shown rolled up which is the preferred method of storing the hammock when not in use. Other methods of collecting the hammock (12) include folding or simply crumpling or collapsing the hammock (12) onto itself for storage inside the frame (11) and on the shelf (15). It should be understood that when reference is made to rolling or collecting the hammock for storage that folding, crumpling and collapsing are also included. Referring to FIGS. 3 and 4, a cover (30) may be placed over the face of the frame (11) to hide the hammock (12) when it is not being used. In the preferred embodiment, the cover (30) comprises two horizontal wood dowels (31) sewn into a hem of a piece of fabric (32). The cover (30) is stretched over the face of the frame (11) and the wood dowels (31) are inserted into slots (33) formed in the frame (11). In another embodiment the cover can simply slide over the entire frame. Numerous configurations of covers and methods of attachments can be accomplished within the scope of the present invention.

Still referring to FIG. 4, connection of the frame (11) to the wall (27) is shown with screws (26) passing through the frame (11) and into the wall (27). If the wall hammock (10) is to be installed on any wall in a home, the screws (26) should pass through the wall (27) and into the wall studs (29) to ensure adequate support for the wall hammock (10). When the hammock (12) is not in use, it can be rolled up and stored on top of the hammock support member (15) and between the vertical members (13) and (14) of the frame (11).

Figure 5:
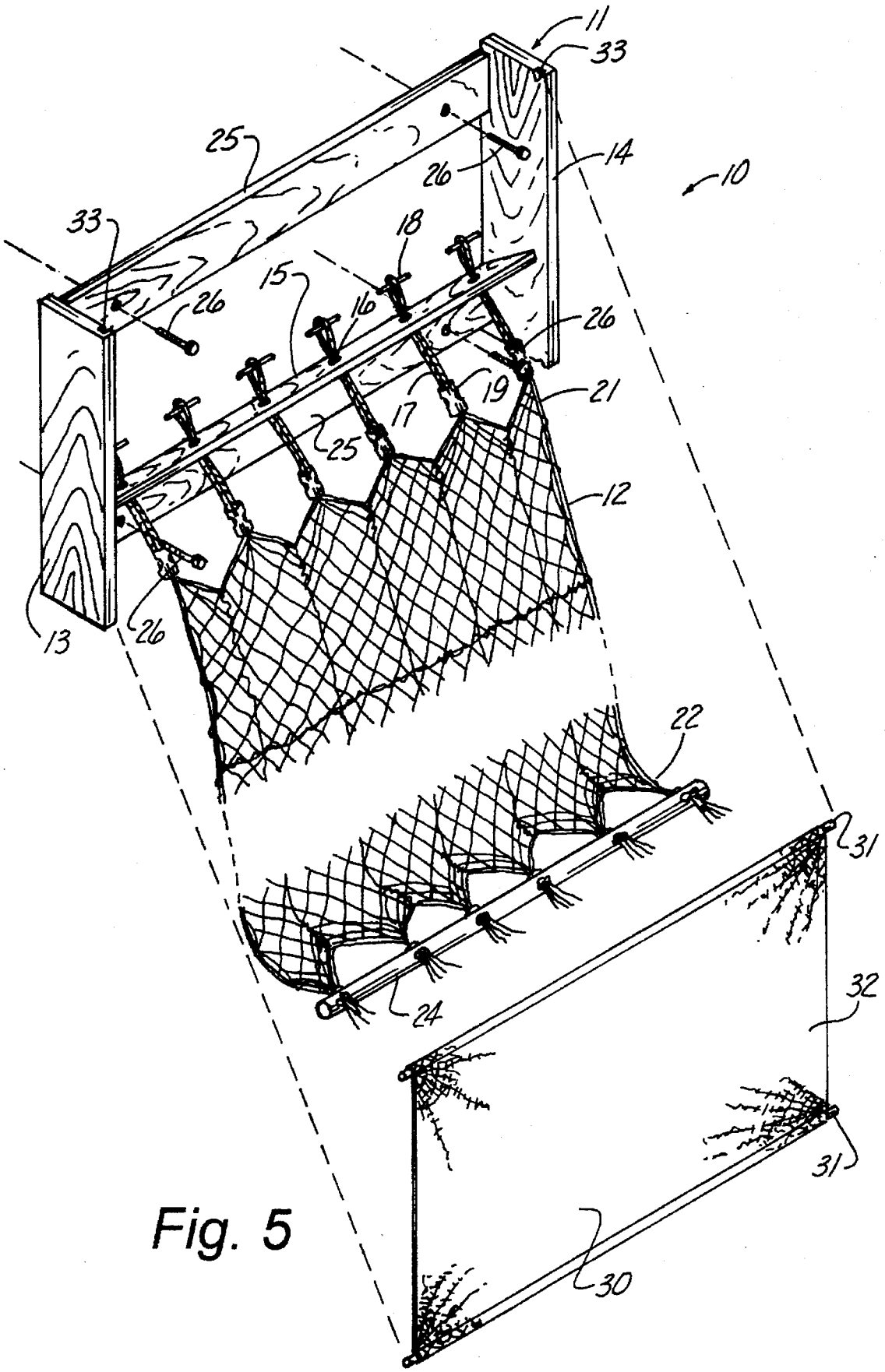
FIG. 5 is an exploded perspective view of a back rest built in accordance with the present invention.

Referring to FIG. 5, the elements of the best mode of constructing a wall hammock (10) built in accordance with the present invention are illustrated. The wall hammock (10) comprises a frame (11) having a left vertical member (13) and a right vertical member (14). A hammock support member (15) is attached to the left and right vertical members (13) and (14). In the preferred embodiment, the hammock support member (15) is inclined from the back to the front of the vertical members (13) and (14). The inclined angle of the hammock support member (15) allows the hammock (12) to lay at a more desirable angle when in use. The inclined angle additionally helps prevent the collected hammock (12) from falling out of the frame (11) when the collected hammock (12) is being stored.

The hammock support member (15) includes holes (16) equally spaced to receive the hammock ropes (17). The hammock ropes (17) are attached by a fastener (19) to the end (21) of hammock (12). Short steel pegs (18) are inserted through a loop at the other end of rope (17). When a tension force is applied to the hammock due to the weight of the user, the pegs (18) are pulled toward, and rest against, the surface of the hammock support member (15) preventing the hammock ropes (17) from being pulled through the holes (16). Recessed grooves (not shown) can be incorporated into the top side of the hammock support member (15). The grooves are positioned at each hole (16) and are used to receive the steel pegs (18).

At the extended end (22) of the hammock (12) a member (24) may be attached to allow the hammock to lay open and to better receive the lower torso of the user. In the preferred embodiment, the member (24) is made of wood and is tied to the end (22) of the hammock (12). The member (22) can be made of virtually any material and can be rigid such as wood or plastic or can be flexible such as a thick braided rope. The member (22) can also help to prevent the hammock from sliding during use when the user is also applying weight to the member (22).

Also in the preferred embodiment, the frame (11) includes two frame mounting members (25) for receiving screws (26) to mount the frame (11) on a wall at a desired location within the home. Various mounting members of different sizes and shapes may be used depending upon the surface on which the frame (11) will be mounted.

Obviously, many modifications and variations of the present invention are possible in light of the above teachings. It is therefore to be understood that, within the scope of the appended claims, the invention may be practiced otherwise than as specifically described.

We claim:

1. A wall hammock comprising;

a frame having a front face;

a hammock, said hammock having a first end and a second end; and wherein said first end of said hammock is attached to said frame, said frame includes a shelf for storing said hammock; and said frame includes a cover removably disposed over the face of said frame.

2. The wall hammock of claim 1 wherein said frame includes means for securely mounting said frame to a desired surface.

3. The wall hammock of claim 1 wherein said hammock is comprised of a woven rope material.

4. The wall hammock of claim 1 wherein said hammock is comprised of a flexible material.

5. The wall hammock of claim 1 including a rigid member attached to said second end of said hammock.

6. The wall hammock of claim 1 including a flexible member attached to said second end of said hammock.

7. A method of storing a wall hammock of a type including a frame attached to a substantially vertical support surface wherein said frame includes an angled shelf, a hammock, said hammock having a first end and a second end, and wherein said first end of said hammock is attached to said angled shelf; said method comprising the steps of:

collecting said second end of said hammock toward said first end of said hammock; and placing said collected hammock on said angled shelf.

8. The method of claim 7 wherein the step of collecting said hammock includes the step of rolling said second end of said hammock toward said first end of said hammock.

9. The method of claim 7 including the step of placing a cover over the face of said frame.

10. A wall hammock comprising;

a frame having a front face at least one rear frame mounting member and a generally planar shelf projecting outwardly from said at least one rear frame mounting member;

a hammock dimensioned to be received on said shelf and having a first end and a second end; wherein said first end of said hammock is attached to said frame; and means associated with said shelf for storing said hammock on said shelf.

11. The wall hammock as in claim 10; wherein said shelf is angled upwardly relative to said frame.

12. The wall hammock as in claim 11; wherein said first end of said hammock is attached to said shelf.

13. The wall hammock as in claim 10; wherein said first end of said hammock is attached to said shelf.

14. The wall hammock of claim 10, wherein said frame includes a cover removably disposed over the face of said frame.

15. The wall hammock of claim 10, including a rigid member attached to said second end of said hammock.

* * * * *